United States Patent [19]

Wise et al.

[11] Patent Number: 4,653,662

[45] Date of Patent: Mar. 31, 1987

[54] WASTE CONTAINER WITH MOVABLE HATCH LIDS

[75] Inventors: Paul W. Wise, Galion, Ohio; Kenneth Limanen, Pleasanton, Calif.

[73] Assignee: Pullman-Peabody, Inc., Galion, Ohio

[21] Appl. No.: 854,522

[22] Filed: Apr. 22, 1986

[51] Int. Cl.[4] ..... B65D 43/20

[52] U.S. Cl. ..... 220/345; 220/346; 220/1 T

[58] Field of Search ..... 220/1 T, 260, 345, 346, 220/1.5

[56] References Cited

U.S. PATENT DOCUMENTS

| | | | |
|---|---|---|---|
| 3,386,206 | 6/1968 | LoveLess | 220/345 |
| 3,514,902 | 6/1970 | Anderson | 220/345 |
| 4,583,655 | 4/1986 | Fisher et al. | 220/346 |

*Primary Examiner*—George T. Hall

*Attorney, Agent, or Firm*—Irvin L. Groh

[57] ABSTRACT

An elongate waste storage container having two top hatches serving as inlets for loading the container. The hatches are sealed by movable hatch lids. A trolley running on a track on the top of the container is arranged to pick up one of the lids at a time and transport it to a position over the other lid for storing during loading of the open hatch. The lifting mechanism on the trolley has a parallogram linkage permitting single operator handling.

17 Claims, 7 Drawing Figures

WASTE CONTAINER WITH MOVABLE HATCH LIDS

This invention relates to a solid waste storage container, and, more particularly, to an elongate container having top hatches for loading provided with lids for sealing the hatches.

Top loading solid waste storage containers commonly are provided with a hinged lid, primarily for keeping weather elements from the inside of the container. In the case of large size industrial containers, the hinged lid becomes so heavy that one person cannot effect opening and closing of the lid. Where the container is transported to a disposal site and where the waste is hazardous, it is desirable or necessary to seal the lid over the loading hatch.

The primary objective of this invention is to provide a top loading storage container with lids that can be sealed and moved from an open to a closed position easily by a single operator.

The foregoing objective is accomplished in a solid waste storage container which has an elongate body having a rectangular frame containing wheels at its four corners so that the container can be easily loaded on a tilt frame vehicle for transportation between a collection and disposal site.

The frame is constructed with a pair of adjacent longitudinally extending hatches which provides top inlets for the waste deposit. Each hatch extends over the transverse width of the container. A pair of lids cover the hatches with a rubber sealing gasket between the lid and frame.

A pair of longitudinally extending rails are mounted on the top of the body frame to form a track for supporting a wheeled transport trolley.

The trolley is constructed with a box frame which transversely spans the body and also substantially spans the longitudinal length of one of the hatches. The wheels are mounted on the four corners of the trolley frame for engagement with the track. The trolley is provided with a lifting mechanism for lifting one of the lids and holding it in a raised position for transport on the trolley from its original sealed position to a holding position over the other of the two lids, allowing loading access to the open hatch.

In a preferred embodiment, the trolley is laterally guided by guide rollers which are mounted on the frame in a horizontal plane adjacent to each of the wheels. The rollers ride on a vertically disposed ways which are located on each longitudinal side of the container. Preferably the rail and way is provided in a unitary structure by an angle which extends the length of the body. The horizonal leg of the angle provides a rail for the trolley wheels and the vertical leg of the angle provided the way for the lateral guiding rollers.

Stops are provided at each longitudinal end of the body by upright brackets mounted on both rails. The trolley is locked in this position with two of its wheels against the stops by locks acting between the trolley and body frames.

A hatch lid lifting mechanism on the trolley provides four widely transversely and longitudinally spaced lifting hooks which engage complementary eyes on the lids. The lifting mechanism itself is in the form of a parallelogram linkage located in a vertical plane with a longitudinally extending fixed side constituting part of the trolley frame and an operating lever which provides over a 4 to 1 mechanical advantage, allowing single operator handling.

A pair of longitudinally spaced pivot shafts transversely span the trolley frame and are journalled on top of a frame member, forming a fixed link of the parallelogram mechanism. The lifting hooks are mounted to the pivot shafts through parallel links which are rigidly attached at one end to the shaft and pivotally attached at the other end to the lifting hooks so the hooks are maintained in a vertical orientation as they are raised and lowered. A pair of parallel arms are attached at one end to one end of each of the pivot shafts, and a horizontally disposed bar link is pivotally attached at the other end of each arm completing the parallelogram. An actuating lever is attached at a midpoint to the bar link with a moving fulcrum pivot connection and a fixed pivotal connection at the end of the lever to the trolley frame in line with the journals. As the actuating lever is rotated, the pivot shafts are rotated through the lever arms to raise or lower the lifting hooks through the parallel links.

The lifting linkage further includes a bearing plate which is mounted on the trolley frame between the journals, and the fixed pivotal connection of the lever to the frame includes a pivot rod fixed adjacent to one end of the actuating lever with a ratchet wheel attached to the lever and the pivot rod passing through the axis of the ratchet wheel and through the bearing plate into a bushing mounted on the frame in line with the journals. A pawl is pivotally mounted on the bearing plate for engagement with the ratchet wheel. The pivot rod rotates with the lever and ratchet wheel which slides against the bearing plate. Upon the engagement of the pawl with the ratchet wheel in the lifting mode, they act as a locking mechanism for holding the hatch lid in an elevated position on the trolley.

The sealing hatches are normally of rectangular configuration with a conforming lid and a gasket of rubber or similar material placed between the lid and top frame member. Upwardly and outwardly flared guide plates are attached to the body frame on all four sides of each hatch to guide the hatch lid into alignment as it is being lowered onto the body over the hatch. The lid is held locked in sealing relationship to the container body by a screw clamps on all four sides of the lid.

In operation, the operator selects the hatch to be loaded and releases the locking pin from the trolley and body frame bushings to move the trolley into position over the selected hatch and lid. The operator then disengages the lid screw clamps and engages the lifting hooks with the eyes on the lid. If the lifting hooks are in the raised position, the pawl is pivoted to release the ratchet wheel so that the lever may be swung to the lower, hook engaging, position of the lift mechanism. With the pawl engaging the ratchet wheel, the lever is then swung to raise the lid free of the hatch. The hatch is held in a raised position by the ratchet lock. The trolley is then moved over the other lid in a temporary storage position as the open hatch is loaded. After loading the container body, the trolley is returned over the hatch opening and the lid lowered in its place and resecured with the screw clamps. Hatch cover guides on the body frame direct the lid into the proper position covering the hatch, and sealing engagement is obtained by the use of a gasket between the lid and body frame.

The objectives of this invention are accomplished by the embodiment disclosed in the following description and illustrated in the drawing in which.

Figure 1:
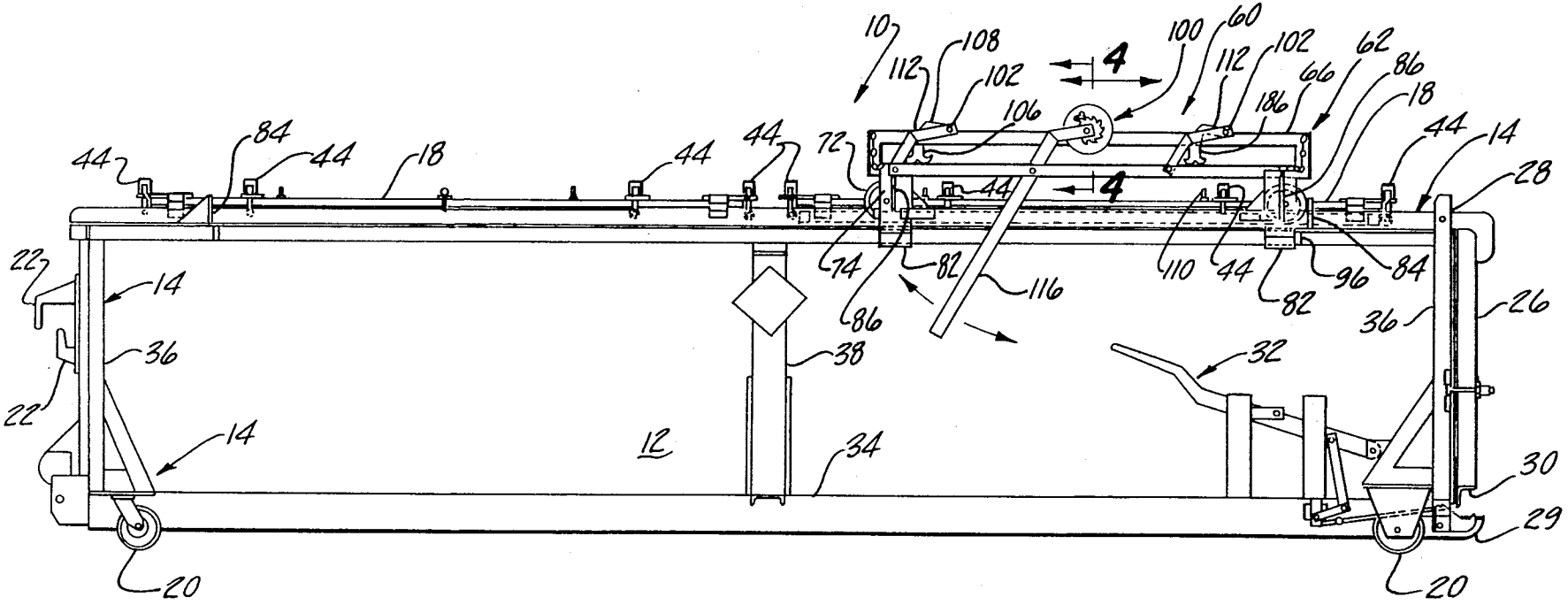
FIG. 1 is an elevational view showing the longitudinal extent of the waste container body with the two adjacent hatch lids in sealing position over the hatch openings and the lid transport trolley located over one of the hatch areas.
Figure 2:
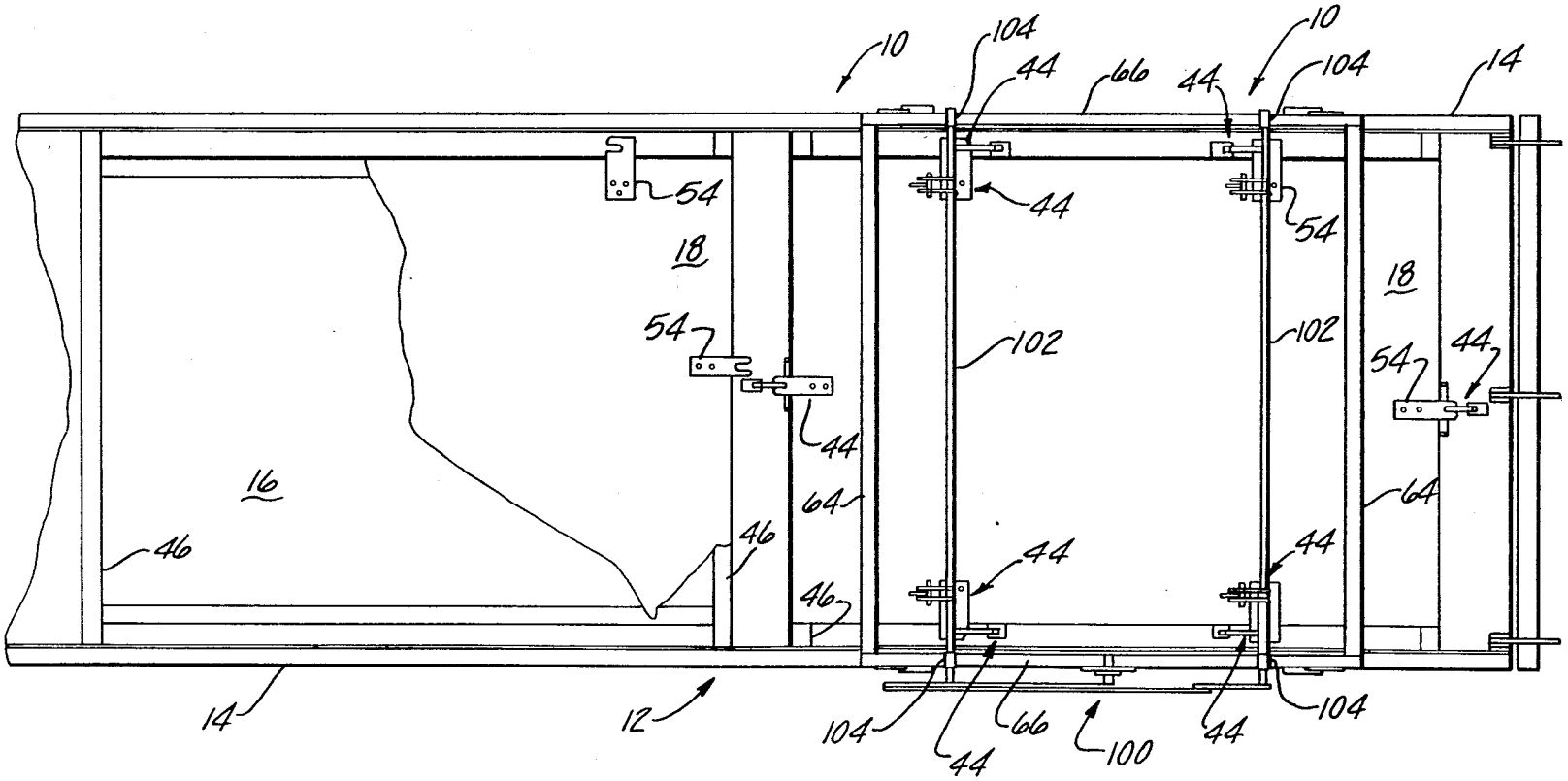
FIG. 2 is a plane view with a portion broken away showing a hatch and the hatch lids in their closing positions over the hatches with their locking mechanisms unlatched.

Referring to FIGS. 1 and 2, solid waste storage container 10 is shown with its longitudinally extending body 12 and support frame 14 presenting two adjacent inlet hatches 16 on the top of the body, covered by hatch lids 18.

Figure 3:
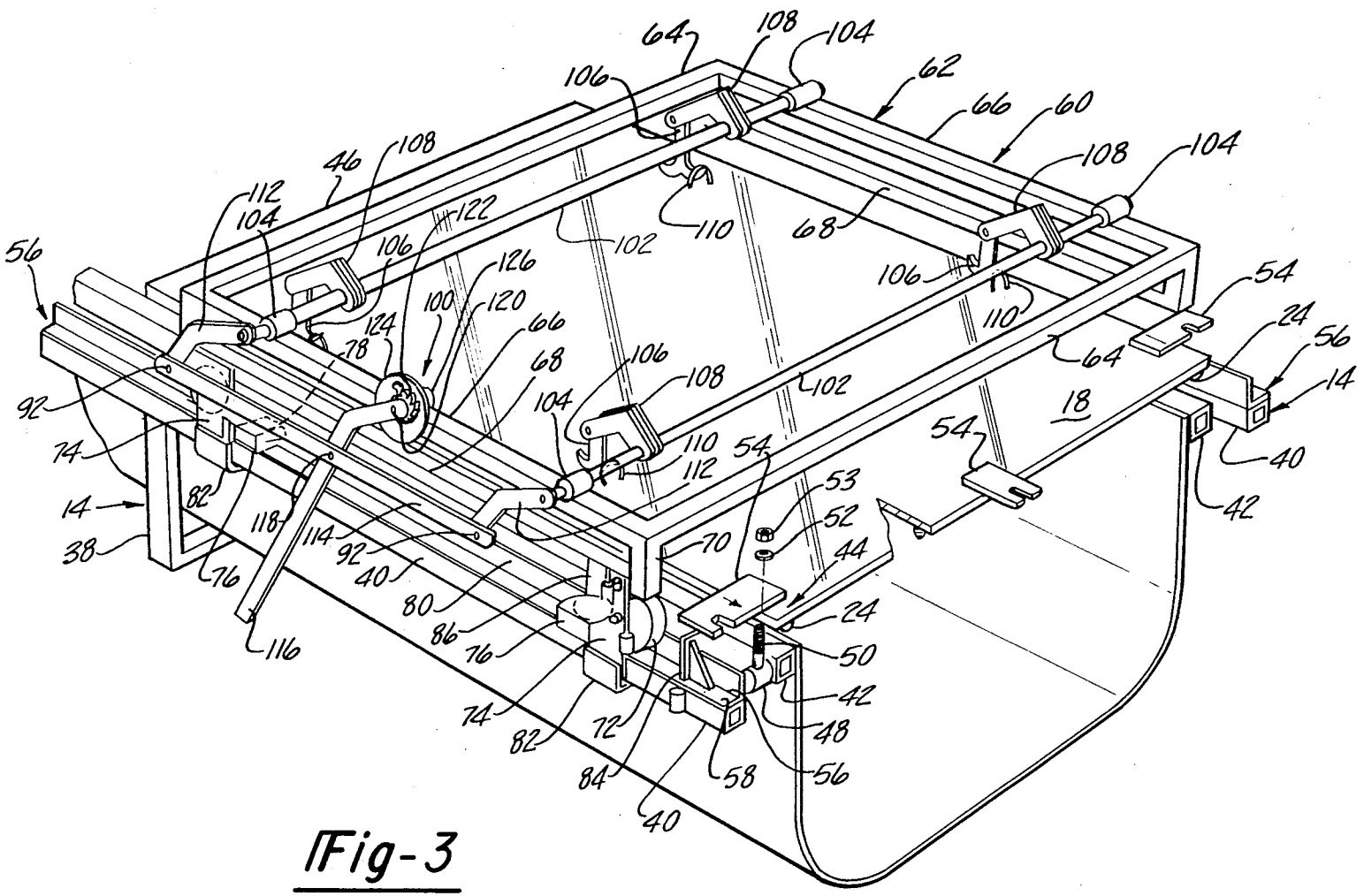
FIG. 3 is a perspective view of one end of the container body showing the details of the lid, the trolley and its lifting mechanism.
Figure 6:
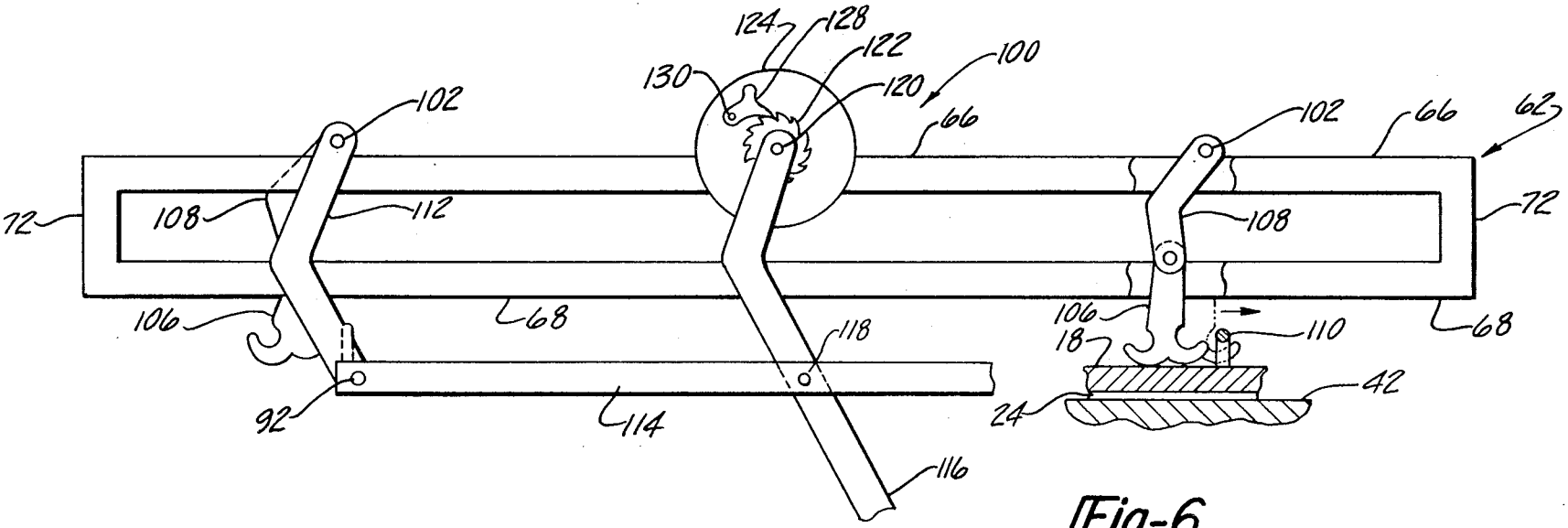
FIG. 6 is an elevational view of a portion of the trolley frame and the lifting mechanism with a portion broken away and in section to show the lifting hook in its lower position for engaging the lifting eyes on the hatch lid.
Figure 7:
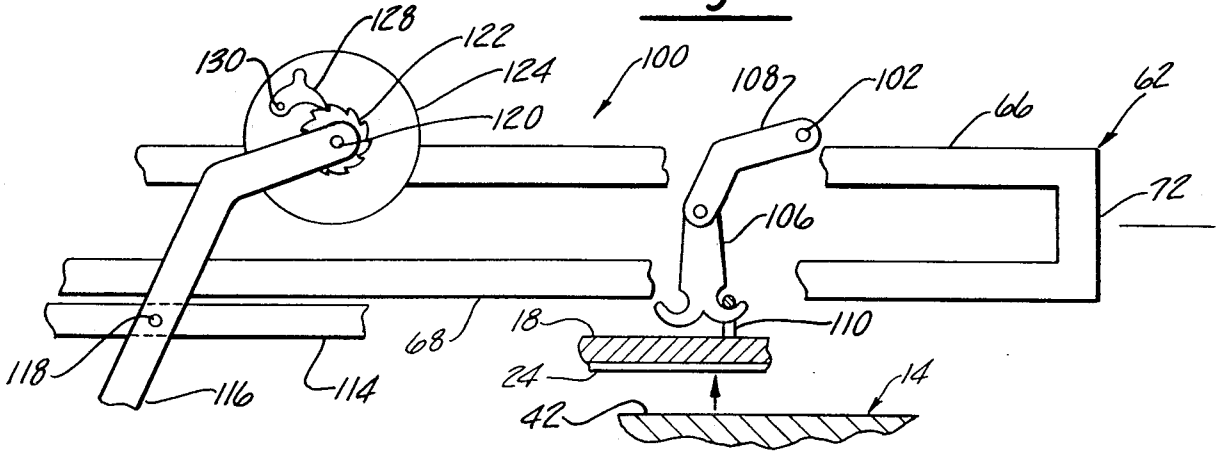
FIG. 7 is a fragmentary view similar to FIG. 6 but showing the lifting mechanism in its raised position with the hatch lid attached.

Waste container 10 is supported on wheels 20 attached to frame 14 so that it can be loaded and unloaded onto a tilt frame truck, not shown, by the use of cables and drives attached to the container by hooks, such as those shown at 22. The container is designed to be totally sealed as by hatch lids 18 and gasket member 24, as shown in FIGS. 3, 6 and 7, and by discharge door 26, which is hinged at 28 and held in sealing relationship by hook members 29 in cooperation with angle member 30, hook members 29 being swung into sealing contact by operating lever system 32. Support frame 14 includes longitudinally extending bottom rectangular support elements 34, upright support elements and channels 36 and 38, longitudinally extending top square tubing members 40 and 42, and top cross members 46.

As best seen in FIGS. 1, 2 and 3, the hatch lids 18 are held in sealing relationship to body 12 by lid locks 44 arranged along all four sides to tighten the lid 18 against square tubing members 42 and cross members 46 with gasket 24 compressed therebetween.

Lid locks 44 are simple screw clamps including a rotating T-bolt 48 having a threaded stem 50 with bearing washer 52 and lock nut 53 which engage in slots in retainer plates 54.

Disposed on top of longitudinally extending frame members 40 on both sides of body 12 are angles 56, the horizontal surfaces of which constitute rails 58 forming a track for hatch lid lifting and transport trolley 60.

Trolley 60 is constructed with a box frame 62 having its horizontal portion spanning the body 12 by transverse frame members 64, top longitudinal frame members 66 and bottom longitudinal frame members 68. Vertical frame members 70 connect horizontal frame members 66 and 68 forming the vertical sides of the trolley frame structure. Transport wheels 72 are located at the four lower corners of the trolley frame 62 to provide transport mobility on track rails 58 between right and left hand inlet hatches 16 and hatch lids 18 as viewed in FIGS. 1 and 2. Outer wheel mounting plate 74 depends from lower frame member 68 and also provides support for bracket 76 mounting lateral guide rollers 78 at the four corners of the trolley frame. The guide rollers ride on vertical portions 80 of angles 56 which serve as ways. Also attached to the lower ends of mounting plates 74 are inwardly directed angle brackets 82 which in cooperation with body frame members 40 restrict the upward movement of the trolley.

Figure 5:
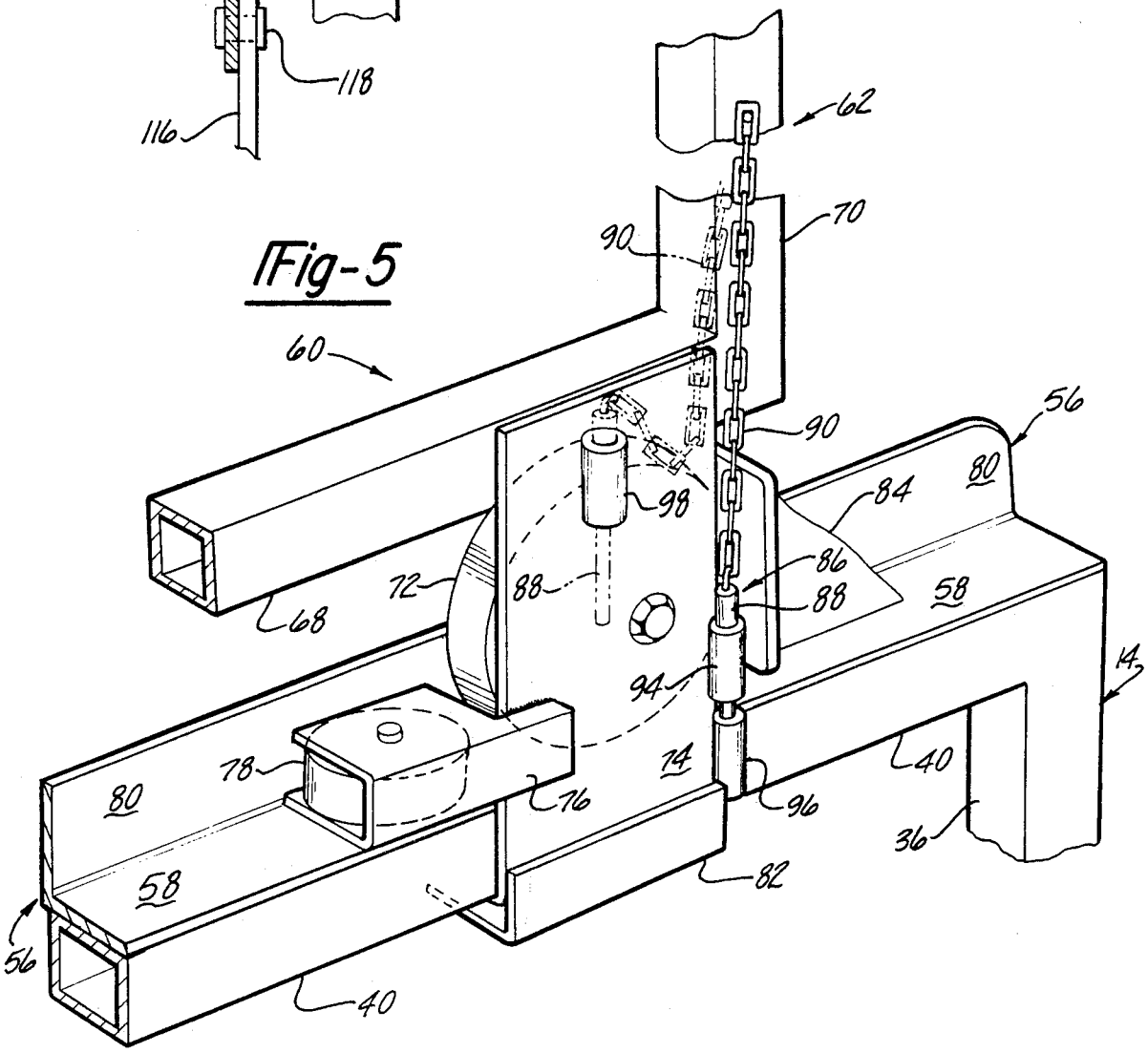
FIG. 5 is a fragmentary perspective view of a portion of the trolley frame showing the details of the support wheel and lateral guide roller and their relationship to the combined rail and way along with the trolley stop and trolley lock.

The longitudinal travel of the trolley 60 is limited at both ends of body 12 by upright stop brackets 84 mounted on both rails 58. The trolley is locked when it is not being moved with wheels 72 against stops 84 by trolley lock 86 which includes pin 88 tethered to trolley frame 62 by chain 90. Lock pin 88 is inserted into trolley frame bushing 94 welded to mounting plate 74 and body frame bushing 96 on frame member 40 in the locked position, as best shown in FIG. 5. Pin 88 is inserted into storage bushing 98 on mounting plate 74 when the trolley is being moved, as shown in FIG. 1.

The hatch lid lifting mechanism 100 is in the form of a parallelogram linkage the fixed link of which includes the top longitudinal member 66 of trolley frame 62. Longitudinally spaced pivot shafts 102 extend transversely across body 12 and are mounted at their ends in journals 104 welded to top frame members 66. Vertically depending lifting hooks 106 are pivotally connected to parallel links 108 a pair of which are affixed to each pivot shaft 102. Lifting hooks 106 engage longitudinally and transversely spaced lifting eyes 110 attached to each hatch lid 18.

Figure 4:
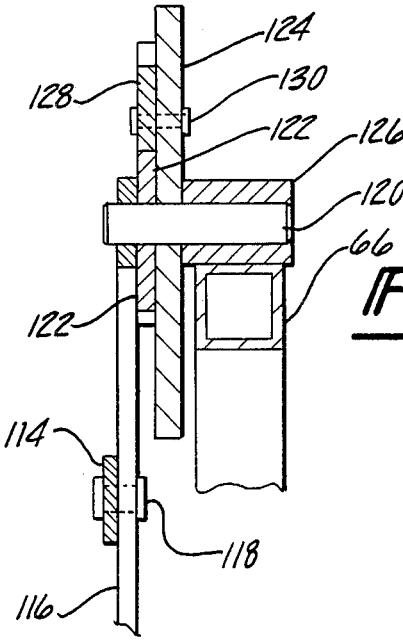
FIG. 4 is sectional view taken along line 4—4 of FIG. 1 showing the details of the ratchet locking mechanism.

A pair of parallel arms 112 are attached at one end to each of the pivot shafts 102. The other ends of arms 112 are pivotally connected at 92 to horizontal bar link 114, completing the parallelogram. The parallelogram 100 is thus defined by a stationary link, frame member 66 between pivot shafts 102, parallel arms 112 and bar link 114 pivoted to parallel arms 112 at 92. An actuating lever 116 is connected with a fulcrum pivot 118 at a midpoint of horizontal bar link 114. The upper end of lever 116 is pivotally connected to the frame member 66 by a pivot pin 120 which is welded to the lever 116 and passes through ratchet wheel 122 also welded to the end of the lever and passes through a bearing plate in the form of disc 124 into bushing 126 mounted on frame member 66, as seen in FIG. 4. A pawl 128 is also pivotally connected at 130 to bearing plate 124 for engagement with ratchet wheel 122. As the lever 116 is rotated in a clockwise direction, pawl 128 will pivot at 130 allowing it to slide over the cam teeth of ratchet wheel 122. When the rotation is stopped, the pawl will lock against the ratchet wheel teeth to maintain the lever in the stopped position against counter clockwise rotation. In use, the operator selects the hatch to be loaded, for example, the right hatch as viewed in FIGS. 1, 2 and 3, and releases the lid screw clamp locks 44 along each edge of the hatch lid 18 by loosening locking nut 53 and swinging the T-bolt 48 out of engagement with the slots in the retainer plates 54 as best seen in FIG. 3. The trolley 60 is released from body frame 14 by removing pin 88 from body bushing 96 and trolley bushing 94 and swinging the attached chain 90 to store the pin 86 in bushing 98 on the trolley frame. This releases trolley wheel 72 which has been held against stop 84. The trolley is then positioned over the lid to be picked up. If the lifting hooks 106 are in the raised position as shown in FIG. 1, pawl 130 is pivoted to release it from ratchet wheel 122, and the lever arm 116 is pivoted by the operator in a counter clockwise direction to lower the lifting hooks 106 for engagement with the lid eyes 110 as shown in FIG. 6. Counter clockwise rotation of lever 116 pivots the bar link 114 to the right swinging the parallel arms 112 in a counter clockwise direction which also rotates pivot shafts 102 with attached parallel links 108 in a counter clockwise direction lowering the hooks 106. With the pawl 130 engaging ratchet wheel 122, the operator then swings the actuating lever 116 in a clockwise direction which raises the lifting hooks 106 and the attached hatch lid 18 as shown in FIGS. 3 and 7. Ratchet wheel and pawl 122 and 130 will retain the lid in its lifted condition as shown in FIG. 3 so that the trolley can then be moved over the other lid (in the left hand position in FIGS. 1 and 2) to a storage position, as waste is loaded through the open hatch 16 on the right hand side of container 10. The trolley may be locked in its holding position on the left hand side by the pin lock 86 on the left hand side of the trolley frame 62. After the right side of the container has been loaded through the right side hatch, the trolley is returned over the open hatch and the lid is lowered in to place and is resecured with the screw clamps. The same procedure is used for the removal and storage of the hatch lid 18 on the left side as the left hand hatch 16 is loaded.

We claim:

1. A solid waste storage container comprising, in combination:

an elongate waste storage body having a pair of adjacent longitudinally extending hatches in the top thereof serving as inlets for waste deposit;

a pair of lids sealingly covering said hatches;

a pair of longitudinally extending rails mounted to the top of said body forming a track;

a lid transport trolley mounted on wheels for movement along said track from a position over one of said lids to a position over the other of said lids; and a lifting mechanism on said trolley for lifting one of said lids and holding said lid in a raised position for transport on said trolley to a holding position over the other of said lids, whereby inlet access is obtained to said container through either of said hatches while its associated lid is positioned in a holding position over the other lid on said trolley.

2. The container of claim 1 wherein said trolley is constructed with a frame transversely spanning said body and substantially spanning the longitudinal length of one of said hatches and wherein said wheels are mounted adjacent the four corners of said frame.

3. The container of claim 2 further comprising means for laterally guiding and trolly including a guide roller mounted on said frame in a horizontal plane adjacent each wheel riding against vertically disposed ways on each longitudinal side of said container.

4. The container of claim 3 wherein said rails and ways are constructed as a pair of longitudinally extending angles.

5. The container of claim 1 further comprising stop means located adjacent the ends of said rails for cooperation with said wheels to limit the longitudinal movement of said trolley at both ends of said body.

6. The container of claim 5 further comprising means for locking said trolley to said body when said wheels are against said stops at either end of said body.

7. The container of claim 1 further comprising means for limiting upward movement of said trolley relative to said body.

8. The container of claim 1 further comprising lock means for holding said lids in a sealing relationship to said body.

9. The container of claim 8 wherein said hatches and lids are rectangular shaped and said lid lock means includes screw clamps on all four sides of said lid.

10. The container of claim 1 wherein said lifting mechanism includes parallelogram linkage for raising longitudinally spaced lifting hooks depending therefrom, said hooks being engagable with said lid.

11. The container of claim 10 wherein said linkage includes a ratchet for locking said lifting mechanism with said lid raised to an elevated position on said trolley.

12. The container of claim 1 further comprising lid guide means mounted on said body adjacent the top thereof for centering said lid as it is lowered on said trolley over one of said edges.

13. A solid waste storage container comprising, in combination:

an elongated waste storage body having a pair of adjacent longitudinally extending hatches in the top thereof serving as inlets for waste products;

a pair of lids sealingly covering said hatches;

a pair of longitudinally extending rails mounted to the top of said body forming a track;

a lid transport trolley constructed with a frame transversely spanning said body and substantially spanning the longitudinal length of one of said hatches having wheels mounted adjacent the four corners of said frame for movement of said trolley along said track from a position over one of said lids to a position over the other of said lids;

said trolley frame having a parallelogram linkage for lifting and holding one of said lids in a raised position including:

a pair of longitudinally spaced pivot shafts transversely spanning said frame and journaled thereon, and a pair of transversely spaced lifting hooks mounted on each of said pivot shafts; and two pairs of transversely and longitudinally spaced lifting eyes attached to each lid for engagement with said lifting hooks;

whereby upon actuation of said linkage, said pivot shafts are rotated to raise and lower a lid on said trolley through said lifting hooks and eyes.

14. The container of claim 13 wherein said lifting hooks are mounted to said pivot shafts through links rigidly attached at one end of said shafts and to which said lifting hooks are pivotally attached at the other end of said links to maintain said lifting hooks in a vertical orientation as they are raised and lowered by rotation by said pivot shafts.

15. The container of claim 14 wherein said linkage includes a pair of parallel arms attached at one end to one end of each of the pivot shafts; and a bar link pivotally attached at the other end of each arm completing said parallelogram with the frame mounting said journals being considered a fixed link.

16. The container of claim 15 wherein said parallelogram linkage further includes an actuating lever having a fulcrum pivot connection at a mid point of said bar link and a fixed pivotal connection between and in line with said journals; whereby rotation of said actuating lever rotates said pivot shafts through said lever arms to raise or lower said lifting hooks through said parallel links.

17. The container of claim 16 wherein said parallelogram linkage further includes a bearing plate mounted on said frame between said journals and said fixed pivotal connection includes a pivot rod attached adjacent one end of said actuating lever, a ratchet wheel affixed to said lever with said pivot rod passing through said ratchet wheel on its axis and through said bearing plate into a brushing mounted on said frame; and a pawl pivotally mounted on said bearing plate for engagement with said ratchet wheel; whereby upon rotation of said lever, said pivot rod rotates with said ratchet wheel which slides against said bearing plate; and upon engagement of said pawl with said ratchet wheel in the lifting mode, said ratchet wheel and pawl act as a locking mechanism for holding a hatch lid in an elevate position on said trolley.

* * * * *